United States Patent [19]

Lloyd

[11] Patent Number: 4,778,424

[45] Date of Patent: Oct. 18, 1988

[54] WATER RESCUE PROJECTILES

[75] Inventor: John Lloyd, Lytham St. Annes, United Kingdom

[73] Assignee: Glasdon Limited, Blackpool, United Kingdom

[21] Appl. No.: 900,394

[22] Filed: Aug. 26, 1986

[51] Int. Cl.[4] ..... B63C 9/26

[52] U.S. Cl. ..... 441/85

[58] Field of Search ..... 441/80, 81, 84, 85

[56] References Cited

U.S. PATENT DOCUMENTS 3,496,580 2/1970 Gulmon et al. ..... 441/85
4,656,679 4/1987 James ..... 441/84

FOREIGN PATENT DOCUMENTS 2506241 8/1976 Fed. Rep. of Germany ..... 441/85
9260 5/1894 United Kingdom ..... 441/85

*Primary Examiner*—Sherman D. Basinger
*Assistant Examiner*—Jesûs D. Sotelo
*Attorney, Agent, or Firm*—Roylance, Abrams, Berdo & Goodman

[57] ABSTRACT

The disclosure relates to a water rescue projectile including an elongate float capable of supporting a victim in water and having one domed shaped leading end and a trailing end to which a flexible sleeve is secured forming a continuation of the elongate float and housing a throwing line attached at one end to the float within the sleeve and having an opposite end to be retained by the thrower. Thus the throwing line is thrown with the float and is payed out from the sleeve in flight to the target.

3 Claims, 1 Drawing Sheet

WATER RESCUE PROJECTILES

BACKGROUND OF THE INVENTION

1. Field of the Invention

This invention relates to water rescue projectiles.

2. Prior Art

U.K. patent specification No. 1479722 discloses a life saving projectile comprising a hollow cylinder containing a coreless cop of line arranged co-axially within the cylinder. The line is intended to float on water but the cylinder is hollow and likely to fill with water and would not therefore provide any buoyancy for the victim to be rescued.

U.K. patent specification No. 1283485 discloses a rescue device in the form of a bag containing a weight, a float to render the bag buoyant and a throwing line. The buoyancy provided would not however support the victim as well.

SUMMARY OF THE INVENTION

The invention provides a water rescue projectile to be thrown to a person to be rescued comprising, an elongate float capable of supporting a victim in the water and one end of which is smoothly shaped to form the leading end of the projectile when thrown and the other end of which has a flexible sleeve attached thereto which extends from the end of the float as a continuation of the float and terminates in an open end. A throwing line housed within the sleeve having one end attached to the float and another end extending from the sleeve to be retained when the projectile is thrown to the person to be rescued so that the throwing line is paid out from the open end of the sleeve as the projectile moves in flight towards the person to be rescued.

DESCRIPTION OF THE PREFERRED EMBODIMENT

Figure 1:
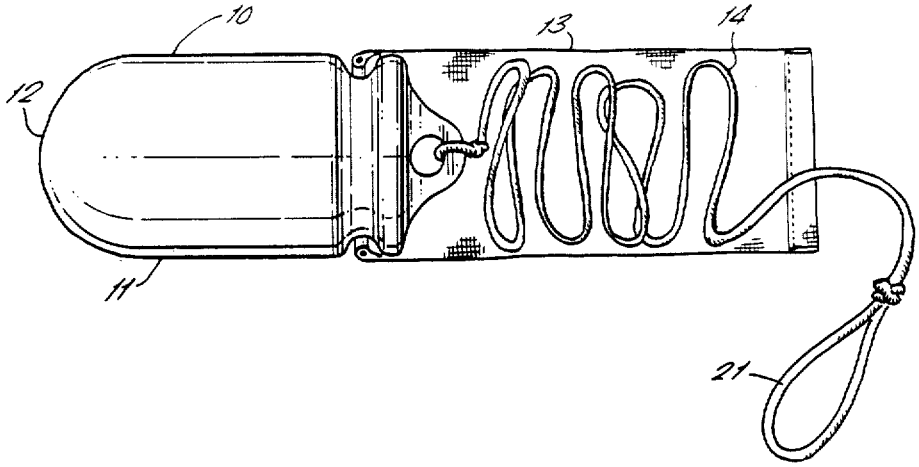
FIG. 1 is a diagrammatic sectional view through a rescue device according to the invention.
Figure 2:
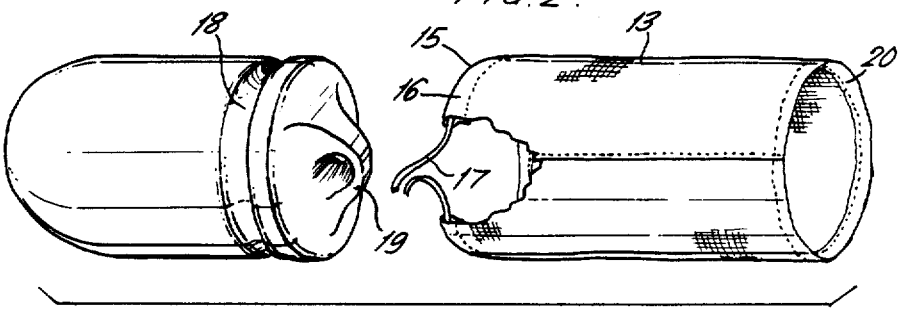
FIG. 2 is a exploded perspective view of part of the rescue device.

The drawings show a water rescue device comprising a hollow plastics torpedo shaped float 10 having a main cylindrical body part 11, a smoothly rounded dome shaped leading end 12 and a flexible fabric sleeve 13 attached to the trailing end of the body to form a continuation of the body housing a throwing line 14 coiled within the sleeve.

The sleeve 13 is of cylindrical form similar in diameter to the body 11 and the end of the sleeve 15 attached to the body is formed with a hem 16 in which a pull cord 17 is disposed. Towards the trailing end, the body 10 has an encircling groove 18 moulded into the outer cylindrical surface of the float to receive the hem 16 by pulling the cord 17 tight and knotting it to attach the sleeve to the float as shown in FIG. 1. The trailing end of the float itself is formed with an integral upstanding eye 19 and one end of the throwing line 14 is securely attached to the eye as can be seen in FIG. 1. The throwing line 14 is coiled in the sleeve 13 and the end of the line 14 extends from the open end 20 of the sleeve remote from the float 10. The free end of the throwing line 14 is formed into a loop 21 to be kept in hand when the projectile is thrown or attached to an anchorage whichever is the most convenient.

In use the projectile is thrown either under-arm or over-arm to the person to be rescued, the end 21 of the throwing line being kept in hand or fixed to a convenient anchorage. The lifeline 14 pays out from the end of the sleeve 13 as the projectile travels towards the person to be rescued.

The torpedo shape of the float provides a much more convenient object to throw than a conventional lifebuoy ring thereby permitting a much more accurate and longer throw to be made. Moreover since the float has a lifeline which can be used to haul the person to be rescued in, the buoyancy of the float can be much reduced as compared with the conventional life ring which is normally required to support the user until a rescue can be made. Thus the buoyancy to be provided by the float can be reduced to a figure in the region of 3 kg., enabling the float to be considerably reduced in size and bulk from the conventional ring. In the case of a lifebuoy to which a lifeline is attached, the rope invariably acts as a break once the buoy has been thrown as it is pulled after the buoy from the static coil. In practice this coil often tangles and stops the buoy prematurely. In the present invention however the whole of the lifeline apart from the end to be anchored is thrown with the rescue device and so is de-accelerating rather than accelerating once thrown and creates far less drag.

I claim:

1. A water rescue projectile to be thrown to a person to be rescued, comprising:

a closed hollow cylindrical float having a dome shaped profile at one end and an integral eye at a second, opposite end;

a generally cylindrical sleeve formed from a flexible material of similar diameter to the cylindrical float;

coupling means for securing one end of the sleeve to said second end of the float with the sleeve extending from said second end of the float and forming a continuation of an outer cylindrical surface of the float, an opposite end of the sleeve being openable, said coupling means including a pull-cord encircling said one end of the sleeve and a groove encircling and formed in the outer surface of the float adjacent said second end thereof, said groove receiving the end of the sleeve encircled by the pull-cord on tightening of the pull-cord to lock the sleeve end in the groove and thereby fasten the sleeve to the float; and a throwing line housed within the sleeve having one end attached to the eye on said second end of the float and an opposite end to be retained by a thrower;

whereby the float can be thrown to a person to be rescued in water with an end of the line retained by the thrower to haul the person to be rescued to safety.

2. A water rescue projectile as claimed in claim 1 wherein the float comprises a hollow moulded plastics body.

3. A water rescue projectile as claimed in claim 1 wherein the sleeve has a "hem" at said one end through which the pull-cord extends to be fastened into the groove on the float.

* * * * *